US010109398B2

(12) United States Patent
Matsumoto

(10) Patent No.: US 10,109,398 B2
(45) Date of Patent: Oct. 23, 2018

(54) CHIP RESISTOR AND METHOD FOR PRODUCING SAME

(71) Applicant: KOA Corporation, Ina-shi, Nagano (JP)

(72) Inventor: Kentaro Matsumoto, Ina (JP)

(73) Assignee: KOA Corporation, Ina-shi (JP)

( * ) Notice: Subject to any disclaimer, the term of this patent is extended or adjusted under 35 U.S.C. 154(b) by 0 days.

(21) Appl. No.: 15/513,725

(22) PCT Filed: Jul. 22, 2015

(86) PCT No.: PCT/JP2015/070866
§ 371 (c)(1),
(2) Date: Mar. 23, 2017

(87) PCT Pub. No.: WO2016/047259
PCT Pub. Date: Mar. 31, 2016

(65) Prior Publication Data

US 2017/0309378 A1 Oct. 26, 2017

(30) Foreign Application Priority Data

Sep. 25, 2014 (JP) ..... 2014-195607
Sep. 26, 2014 (JP) ..... 2014-197236

(51) Int. Cl.
*H01C 1/012* (2006.01)
*H01C 7/00* (2006.01)
(Continued)

(52) U.S. Cl.
CPC ..... *H01C 7/003* (2013.01); *H01C 1/142* (2013.01); *H01C 7/20* (2013.01); *H01C 17/06513* (2013.01); *H01C 17/283* (2013.01)

(58) Field of Classification Search
CPC ..... H01C 7/003; H01C 1/142; H01C 1/148; H01C 17/06; H01C 17/30; H01C 17/283
(Continued)

(56) References Cited

U.S. PATENT DOCUMENTS 5,339,068 A * 8/1994 Tsunoda ..... H01C 1/02 338/308
6,727,798 B2 * 4/2004 Akhtman ..... H01C 1/142 338/309
(Continued)

FOREIGN PATENT DOCUMENTS

CN 101268525 A 9/2008
CN 101593589 A 12/2009
(Continued)

OTHER PUBLICATIONS

Nose et al., JP 08-097003A, machine translation. Apr. 1996.*
(Continued)

*Primary Examiner* — Kyung Lee
(74) *Attorney, Agent, or Firm* — Crowell & Moring LLP

(57) ABSTRACT

The invention is to provide a chip resistor suitable for lowering an initial resistance value. A chip resistor 1 according to the present invention is provided with: an insulating substrate 2; a pair of front electrodes 3 which are provided on a front surface of the insulating substrate 2 so as to face each other with a predetermined interval therebetween; a resistive element 4 which is provided so as to bridge the front electrodes 3; a pair of auxiliary electrodes 5 which are provided so as to cover the front electrodes 3 and overlap end portions of the resistive element 4; and the like. The chip resistor 1 is configured such that: the front electrodes 3 are formed of a material which contains 1 to 5 wt % Pd and the balance Ag; and the auxiliary electrodes 5 are formed of a material which contains 15 to 30 wt % Pd and a metal
(Continued)

material (e.g. Au) lower in resistivity than Pd and the balance Ag.

6 Claims, 10 Drawing Sheets

(51) Int. Cl.
*H01C 1/142* (2006.01)
*H01C 7/20* (2006.01)
*H01C 17/065* (2006.01)
*H01C 17/28* (2006.01)

(58) Field of Classification Search
USPC ..... 338/307, 309
See application file for complete search history.

(56) References Cited

U.S. PATENT DOCUMENTS

| | | | | |
|---|---|---|---|---|
| 7,098,768 | B2 * | 8/2006 | Doi | H01C 1/14 338/309 |
| 7,782,173 | B2 * | 8/2010 | Urano | H01C 1/012 338/307 |
| 7,782,174 | B2 * | 8/2010 | Urano | H01C 1/012 338/307 |
| 7,786,842 | B2 * | 8/2010 | Tsukada | H01C 7/003 338/309 |
| 2009/0115569 | A1 | 5/2009 | Urano | |
| 2010/0201477 | A1 * | 8/2010 | Yang | H01C 1/032 338/309 |

FOREIGN PATENT DOCUMENTS

| | | | |
|---|---|---|---|
| CN | 101681702 | A | 3/2010 |
| JP | 61-119004 | A | 6/1986 |
| JP | 1-93193 | A | 12/1989 |
| JP | 2-44702 | A | 2/1990 |
| JP | 2-93193 | A | 4/1990 |
| JP | 4-250601 | A | 9/1992 |
| JP | 8-97003 | A | 4/1996 |
| JP | 8-102403 | A | 4/1996 |
| JP | 2000-77205 | A | 3/2000 |
| JP | 2002-64003 | A | 2/2002 |
| JP | 2003-68502 | A | 3/2003 |
| JP | 2007-88161 | A | 4/2007 |
| JP | 2008-53251 | A | 3/2008 |
| JP | 2008-182128 | A | 8/2008 |
| JP | 2008-300607 | A | 12/2008 |
| WO | WO 2008/149876 | A1 | 12/2008 |

OTHER PUBLICATIONS

Shimada et al., JP 2008-053251A, machine translation. Mar. 2008.*
Matsui et al, JP 2008-300607A. machine translation. Dec. 2008.*
Chinese-language Office Action issued in counterpart Chinese Application No. 201580051418.8 dated Feb. 5, 2018 (seven (7) pages).
International Search Report (PCT/ISA/210) issued in PCT Application No. PCT/JP2015/070866 dated Oct. 20, 2015 with English translation (five pages).
Japanese-language Written Opinion (PCT/ISA/237) issued in PCT Application No. PCT/JP2015/070866 dated Oct. 20, 2015 (four pages).
Japanese-language Office Action issued in counterpart Japanese Application No. 2014-195607 dated May 22, 2018 (three (3) pages).
Japanese-language Office Action issued in counterpart Japanese Application No. 2014-197236 dated May 22, 2018 (four (4) pages).

* cited by examiner

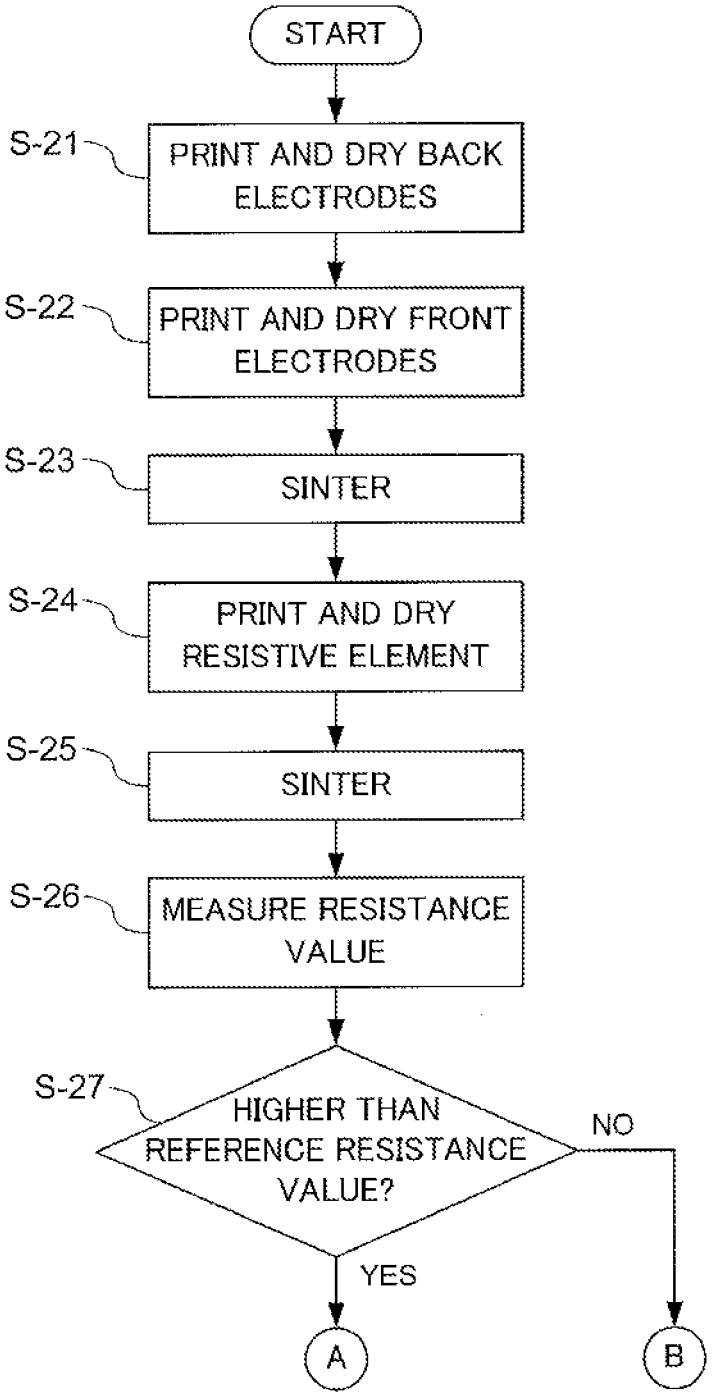
START
S-21
PRINT AND DRY BACK ELECTRODES
S-22
PRINT AND DRY FRONT ELECTRODES
S-23
SINTER
S-24
PRINT AND DRY RESISTIVE ELEMENT
S-25
SINTER
S-26
MEASURE RESISTANCE VALUE
S-27
HIGHER THAN REFERENCE RESISTANCE VALUE?
NO
YES
A
B

CHIP RESISTOR AND METHOD FOR PRODUCING SAME

TECHNICAL FIELD

The present invention relates to a surface mount type chip resistor and a method for producing the chip resistor.

BACKGROUND ART

A chip resistor is mainly constituted by a cuboid-shaped insulating substrate, a pair of front electrodes, a pair of back electrodes, end surface electrodes, a resistive element, a protective layer, etc. The pair of front electrodes are disposed on a front surface of the insulating substrate so as to face each other with a predetermined interval therebetween. The pair of back electrodes are disposed on a back surface of the insulating substrate so as to face each other with a predetermined interval therebetween. The end surface electrodes bridge the front electrodes and the back electrodes respectively. The resistive element bridges the front electrodes paired with each other. The protective layer covers the resistive element.

Generally, such a chip resistor is produced in the following manner. That is, electrodes, resistive elements, protective layers, etc. corresponding to a number of chip resistors are formed collectively on a large-sized aggregate substrate. Then, the aggregate substrate is divided along division lines (e.g. division grooves) arranged into a latticed pattern so that the number of chip resistors can be obtained. In such a chip resistor producing process, a resistive paste is printed and sintered on one surface of the aggregate substrate to thereby form a number of resistive elements. However, due to the influence of positional displacement or blurring during the printing or temperature unevenness in a sintering furnace etc., it is difficult to avoid generation of some variation in size or film thickness among the resistive elements. For this reason, it is necessary to perform resistance value adjustment work for forming a trimming groove in each resistive element in the state of the aggregate substrate so as to set a resistance value of the resistive element at a desired one.

In the resistance value adjustment work, laser light is applied to the resistive element to form the trimming groove therein while probes are brought into contact with the pair of front electrodes bridged by the resistive element, to thereby measure the resistance value. As the trimming groove is made longer, the resistance value of the resistive element becomes higher. Therefore, as soon as the resistance value of the resistive element as a subject to be trimmed has arrived at a target resistance value (reference resistance value), application of the laser light is stopped to terminate the resistance value adjustment work.

However, the resistance value (initial resistance value) prior to formation of the trimming groove is not always lower than the reference resistance value. Due to a variation in printing conditions, sintering conditions etc. among resistive elements, the initial resistance value may be higher than the reference resistance value. In this case, the resistance value cannot be lowered by trimming. Therefore, the resistive element having the initial resistance value has to be discarded as a defective product.

To solve this problem, the following technique has been heretofore proposed, as disclosed in JP-A-61-119004 (for example, see Patent Literature 1). That is, when an initial resistance value of a resistive element is higher than a reference resistance value, another resistive paste is printed on the resistive element and sintered again to thereby lower the initial resistance value. Then, a trimming groove is formed in the resistive element in which such a two-layer structure has been arranged. Consequently, the resistance value is adjusted. As in the background-art technique, another resistive paste is separately superimposed and printed on a resistive element which has been formed on an insulating substrate, and the resistive paste is sintered to lower the initial resistance value of the resistive element. In this manner, a component which would have been discarded as a defective product can be used as a good product. Therefore, a yield rate can be improved to provide an inexpensive chip resistor. In addition, JP-A-4-250601 discloses the following technique. That is, how much higher an initial resistance value of a resistive element is than a reference resistance value is measured, and a chip resistor is sintered again under heating conditions corresponding to a result of the measurement, so that the initial resistance value can approach the reference resistance value.

CITATION LIST

Patent Literature

Patent Literature 1: JP-A-61-119004
Patent Literature 2: JP-A-4-250601

SUMMARY OF INVENTION

Technical Problems

In this type of chip resistor, it is preferable that resistivity of front electrodes connected to opposite ends of the resistive element are as low as possible. Due to various other factors such as material cost or environmental friendliness, a paste material containing silver as a main component is used for the front electrodes. Therefore, when a repeated sintering step is performed in order to lower the resistance value as in the aforementioned background-art techniques, an amount of silver of the front electrodes diffused into the resistive element increases. A separation phenomenon that silver at edge portions of the front electrodes connected to the resistive element is lost accordingly. In the worst case, this may result in disconnection.

For example, assume that 100% silver or 98% silver-2% palladium is used as the paste material containing silver as a main component, and a resistive paste is printed and sintered to partially overlap the front electrodes formed of such a silver-rich material, so that a resistive element can be formed. In this case, due to diffusion of silver of the front electrodes into the resistive element during the sintering, the resistive element may be affected by the silver material poor in temperature characteristics to thereby result in deterioration of TCR characteristics, or silver at the edge portions of the front electrodes connected to the resistive element may be lost to cause a separation phenomenon. In the worst case, this may result in disconnection. Particularly, in the case of the chip resistor in which the resistive element is formed into a two-layer structure to lower the resistance value as in the background-art technique disclosed in the JP-A-61-119004, silver is diffused when the first layer of the resistive element is sintered. In addition, diffusion of silver further advances when the second layer of the resistive element is sintered. Therefore, the aforementioned problems about the deterioration of TCR characteristics and the separation are conspicuous.

The invention has been accomplished in consideration of the actual circumstances of the aforementioned background-art techniques. An object of the invention is to provide a chip resistor suitable for lowering an initial resistance value and a method for producing the chip resistor.

Solution to Problems

In order to achieve the foregoing object, the invention provides a chip resistor including: an insulating substrate; a pair of front electrodes which are provided on a front surface of the insulating substrate so as to face each other with a predetermined interval therebetween; a resistive element which is provided to extend onto the pair of front electrodes; and auxiliary electrodes which are provided so as to cover the front electrodes and overlap end portions of the resistive element; wherein: the front electrodes are formed of a material which contains 1 to 5 wt % palladium and the balance silver, and the auxiliary electrodes are formed of a material containing 15 to 30 wt % palladium and a metal material lower in resistivity than palladium, and the balance silver.

In the chip resistor configured thus, the front electrodes connected to the opposite end portions of the resistive element are covered with the auxiliary electrodes. Since the front electrodes are formed of the silver-rich material containing a small amount of palladium and the balance of a large amount of silver, a change amount (drop amount) of a resistance value in the resistive element which has been sintered repeatedly can be increased. On the other hand, due to an increase in an amount of silver of the front electrodes diffused into the resistive element, a separation phenomenon easily occurs at edge portions of the front electrodes connected to the resistive element. Here, the auxiliary electrodes are formed of the material containing a smaller amount of silver and the balance of a larger amount of palladium etc. than the front electrodes. Adhesive strength between palladium of the auxiliary electrodes and palladium of the front electrodes is high. Accordingly, electrical continuity can be secured by palladium of the auxiliary electrodes in the edge portions of the front electrodes from which silver has been lost due to the diffusion. Thus, a disconnection accident caused by separation can be prevented surely. In addition, even when the auxiliary electrodes contain a large amount of palladium high in resistivity, a metal material such as gold lower in resistivity than palladium is also contained in the auxiliary electrodes. Therefore, even when positions of probes brought into contact with the auxiliary electrodes have a variation during resistance value adjustment for making the resistance value of the resistive element approach a target reference resistance value, the variation hardly affects accuracy of measurement of the resistance value. Thus, the resistance value can be measured stably.

In the aforementioned configuration, a countervailing distance between the auxiliary electrodes may be set to be narrower than a countervailing distance between the front electrodes. In this case, an inter-electrode distance of a current flowing in the resistive element is regulated by the narrower countervailing distance between the auxiliary electrodes. Thus, the initial resistance value of the resistive element can be lowered accordingly.

In addition, in the aforementioned configuration, the resistive element may have a resistance value which has been lowered by re-sintering. In this case, even when the resistive element would have been discarded as a defective product due to the initial resistance value higher than the reference resistance value, the resistive element can be reproduced as a good product. Thus, a yield rate can be improved.

Moreover, in order to achieve the foregoing object, the invention provides a method for producing a chip resistor including: a step of printing and sintering a paste material on a front surface of an insulating substrate to form a pair of front electrodes, the paste material containing silver as a main component; a step of printing and sintering a resistive paste to form a resistive element so that the resistive element can extend onto the pair of front electrodes; a step of bringing probes into contact with the pair of front electrodes to measure an initial resistance value of the resistive element; a step of forming a pair of auxiliary electrodes so as to cover the front electrodes and overlap end portions of the resistive element only when the initial resistance value is higher than a reference resistance value; and a step of re-sintering the resistive element after formation of the auxiliary electrodes so as to lower the initial resistance value; wherein: the auxiliary electrodes are formed by printing and sintering a paste material containing at most 85 wt % silver and the balance at least palladium.

In the method for producing the chip resistor according to the invention, when the probes brought into contact with the pair of front electrodes measure the initial resistance value of the resistive element, the resistance value may be higher than the target reference resistance value. Even in this case, the resistive element is not discarded as a defective product but the auxiliary electrodes are formed and superimposed on the front electrodes, and thereafter, the resistive element is sintered again to lower the initial resistance value. Here, since the front electrodes in a lower layer are formed of the material containing silver as a main component, a change amount (drop amount) of the resistance value in the resistive element which has been repeatedly sintered increases. On the other hand, due to an increase in an amount of silver of the front electrodes diffused into the resistive element, a separation phenomenon occurs easily at edge portions of the front electrodes connected to the resistive element. Moreover, the auxiliary electrodes in an upper layer are formed of the material containing a small amount of silver and the balance of a large amount of palladium. Therefore, electrical continuity can be secured by palladium of the auxiliary electrodes at the edge portions of the front electrodes from which silver has been lost due to the diffusion. Thus, a disconnection accident caused by the separation can be prevented surely.

In the aforementioned producing method, a countervailing distance between the pair of auxiliary electrodes may be set at a fixed one in advance. However, the countervailing distance between the auxiliary electrodes may be made changeable in accordance with a divergence amount of the initial resistance value from the reference resistance value. In this case, the resistance value can be changed and aimed at an initial resistance value in which the resistance value can be adjusted easily.

In the aforementioned producing method, the auxiliary electrodes may be superimposed on the end portions of the resistive element to make the countervailing distance between the auxiliary electrodes narrower than the countervailing distance between the front electrodes. In this case, the resistance value can be lowered when the resistive element is sintered again. In addition, the resistance value can be also lowered by the countervailing distance between the auxiliary electrodes. That is, since an inter-electrode distance of a current flowing in the resistive element is determined by a narrower one of the countervailing distance between the front electrodes and the countervailing distance between the auxiliary electrodes, the initial resistance value of the resistive element can be lowered accordingly when the countervailing distance between the auxiliary electrodes is made narrower than the countervailing distance between the front electrodes. In addition, the current flowing in the resistive element flows through the auxiliary electrodes which contain a large amount of palladium. Therefore, the current jumps over portions of the resistive element in the vicinities of the front electrodes from which a large amount of silver has been diffused. Accordingly, temperature characteristics can be also improved.

In addition, in the aforementioned producing method, the front electrodes may be formed of a material containing 1 to 5 wt % palladium and the balance silver; and the auxiliary electrodes may be formed of a material containing 15 to 30 wt % palladium and a metal material lower in resistivity than palladium and the balance silver. In this case, adhesive strength between the front electrodes and the auxiliary electrodes is enhanced due to palladium contained in both the front electrodes and the auxiliary electrodes. In addition, the metal material such as gold lower in resistivity than palladium is also contained in the auxiliary electrodes. Therefore, even when the positions of the probes brought into contact with the auxiliary electrodes have a variation during resistance value adjustment for forming a trimming groove, the variation hardly affects accuracy of measurement of the resistance value. Accordingly, the resistance value can be measured stably.

Advantageous Effects of Invention

According to the invention, it is possible to provide a chip resistor suitable for lowering an initial resistance value and a method for producing the chip resistor.

BRIEF DESCRIPTION OF DRAWINGS

FIGS.

FIG. 7 A flow chart (part 1) showing the producing steps of the chip resistor shown in FIGS. 2A-2H.

DESCRIPTION OF EMBODIMENTS

Embodiments of the invention will be described below with reference to the drawings.

[First Embodiment]

Figure 1:
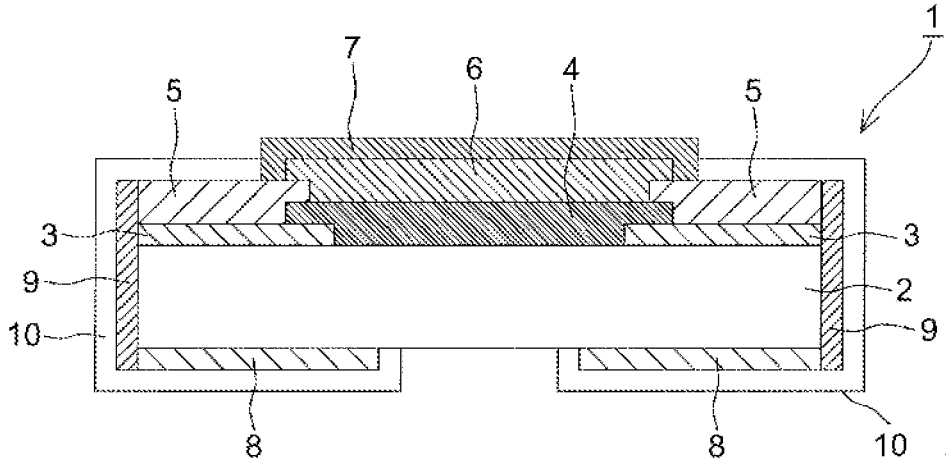
FIG. 1 A sectional view of a chip resistor according to a first embodiment of the invention.
Figure 2A:
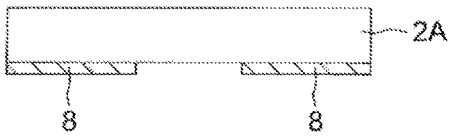
FIGS. 2A-2H Sectional views showing producing steps of the chip resistor shown in FIG. 1.
Figure 2B:
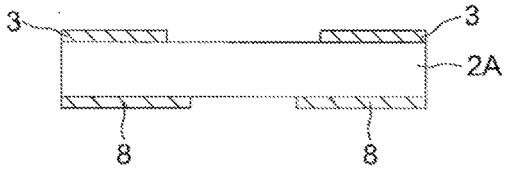
Figure 2C:
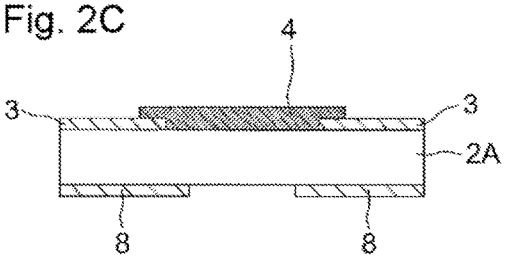
Figure 2D:
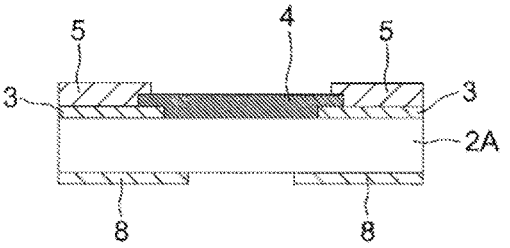
Figure 2E:
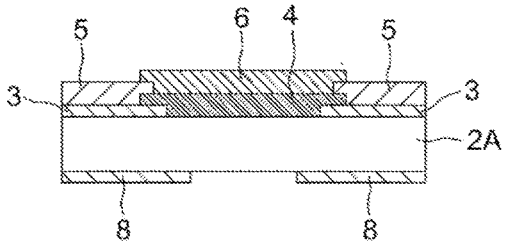
Figure 2F:
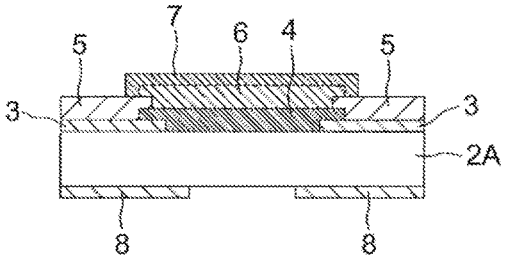
Figure 2G:
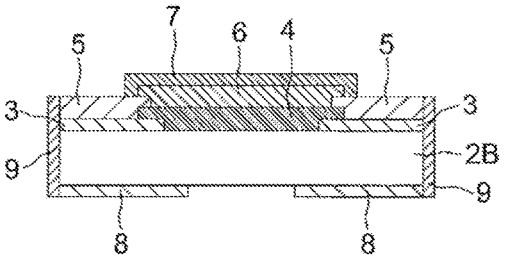
Figure 2H:
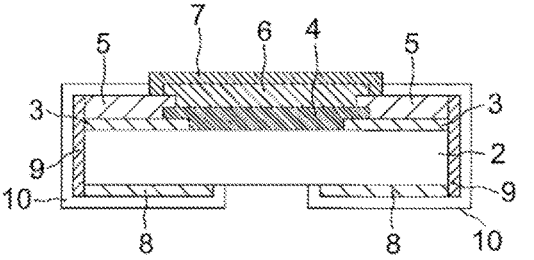

FIG. 1 is a sectional view of a chip resistor according to a first embodiment of the invention. As shown in FIG. 1, the chip resistor 1 according to the first embodiment of the invention is mainly constituted by a cuboid-shaped insulating substrate 2, a pair of front electrodes 3, a resistive element 4, a pair of auxiliary electrodes 5, a first protective layer 6, a second protective layer 7, a pair of back electrodes 8, a pair of end surface electrodes 9, and plating layers 10. The pair of front electrodes 3 are provided on longitudinally opposite end portions in an upper surface of the insulating substrate 2. The resistive element 4 is provided to extend onto the front electrodes 3. The pair of auxiliary electrodes 5 are provided so as to cover the front electrodes 3 and overlap end portions of the resistive element 4. The first protective layer 6 covers the resistive element 4. The second protective layer 7 covers the first protective layer 6. The pair of back electrodes 8 are provided on longitudinally opposite end portions in a lower surface of the insulating substrate 2. The pair of end surface electrodes 9 are provided on side surfaces of the insulating substrate 2 so as to bridge the front electrodes 3 with the auxiliary electrodes 5 and the back electrodes 8 correspondingly and respectively. The plating layers 10 cover the auxiliary electrodes 5, the back electrodes 8 and the end surface electrodes 9 respectively.

The insulating substrate 2 is formed of ceramics etc. When a large-sized aggregate substrate (see FIG. 2) which will be described later is divided along primary division grooves and secondary division grooves which extend vertically and horizontally, a number of the insulating substrates 2 can be obtained.

The front electrodes 3 are obtained by screen-printing, drying and sintering an Ag (silver)-based paste material containing 1 to 5 wt % Pd (palladium). In the embodiment, a so-called Ag-rich Ag—Pd paste containing 2 wt % Pd and the balance (98 wt %) Ag is used for forming the front electrodes 3.

The resistive element 4 is obtained by screen-printing, drying and sintering a resistive paste of ruthenium oxide etc. The opposite end portions of the resistive element 4 overlap the front electrodes 3. Incidentally, although details will be described later, laser light is applied to the resistive element 4 and the first protective layer 6 to form a trimming groove therein. Accordingly, a resistance value of the chip resistor 1 can be adjusted to a target reference resistance value.

The auxiliary electrodes 5 are obtained by screen-printing, drying and sintering an Ag-based paste material containing 15 to 30 wt % Pd and a metal material (e.g. gold or copper) lower in resistivity than Pd, and the balance Ag. In the embodiment, an Ag—Pd—Au paste containing 20 wt % Pd, 5 wt % Au (gold) and the balance (75%) Ag is used for forming the auxiliary electrodes 5.

The first protective layer 6 and the second protective layer 7 constitute an insulating layer having a two-layer structure. Of the insulating layer, the first protective layer 6 is an undercoat layer which covers the resistive element 4 before the trimming groove is formed, and the second protective layer 7 is an overcoat layer which covers the first protective layer 6 after the trimming groove is formed. The first protective layer 6 is obtained by screen-printing, drying and sintering a glass paste. The first protective layer 6 covers an upper surface of the resistive element 4 and overlaps end portions of the auxiliary electrodes 5. The second protective layer 7 is obtained by screen-printing and thermally curing (baking) an epoxy resin-based paste. The second protective layer 7 entirely covers an upper surface and end surfaces of the first protective layer 6.

The back electrodes 8 are obtained by screen-printing, drying and sintering an Ag paste or an Ag—Pd paste containing a small amount of Pd.

The end surface electrodes 9 are formed by sputtering nickel (Ni)/chromium (Cr) etc. The end surface electrodes 9, the auxiliary electrodes 5 and the back electrodes 8 are covered with the plating layers 10 formed by Ni plating, solder plating, or the like.

Figure 3:
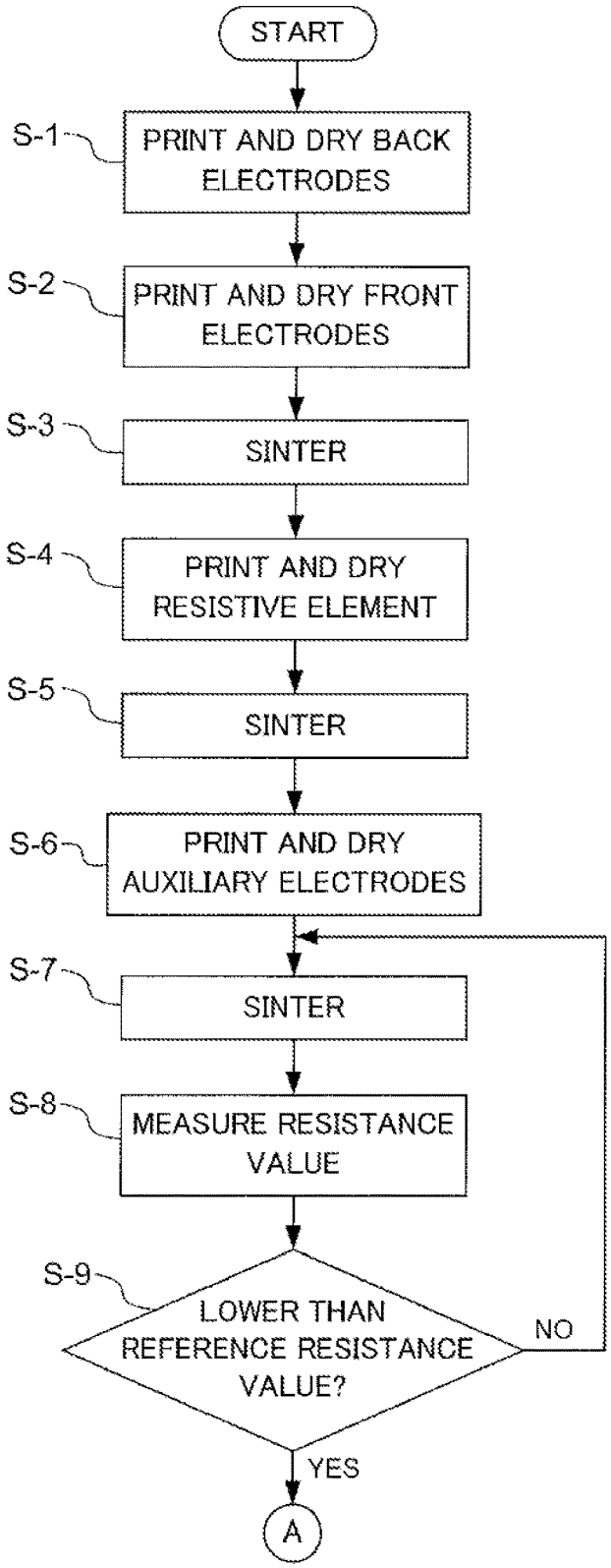
FIG. 3 A flow chart (part 1) showing the producing steps of the chip resistor shown in FIG. 1.
Figure 4:
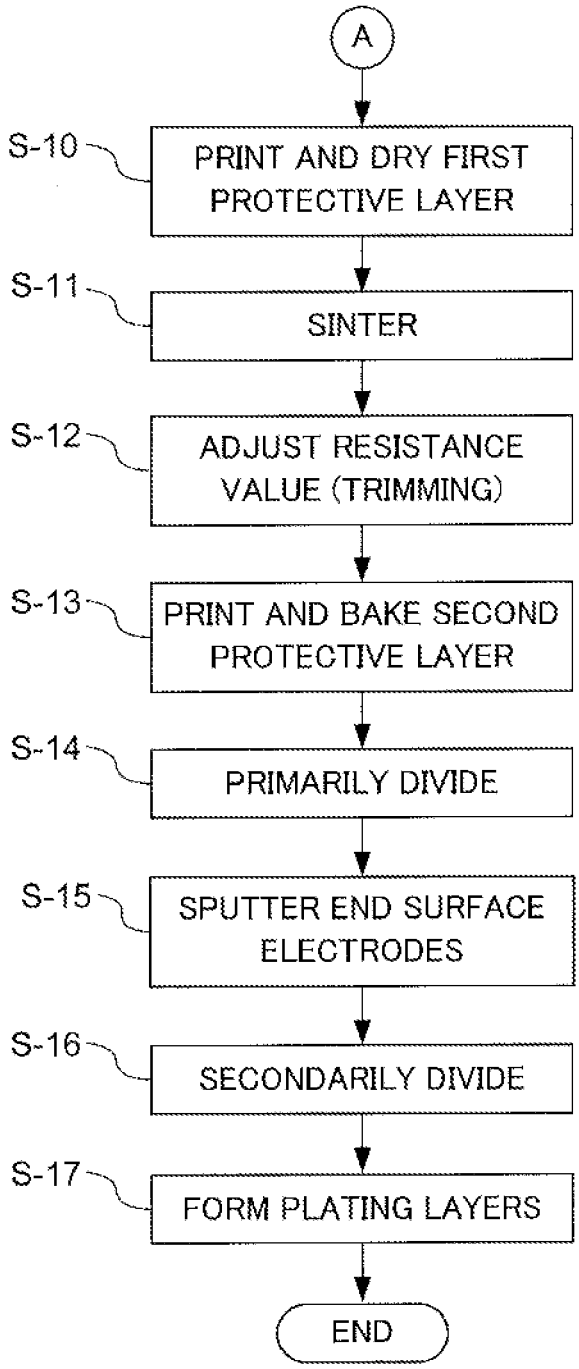
FIG. 4 A flow chart (part 2) showing the producing steps of the chip resistor shown in FIG. 1.

Next, a method for producing the chip resistor 1 configured as described above will be described with reference to FIGS. 2 to 4. Incidentally, FIG. 2 are sectional views showing producing steps of the chip resistor shown in FIG. 1. FIG. 3 and FIG. 4 are flow charts showing the producing steps of the chip resistor shown in FIG. 1. One processing procedure is shown in FIG. 3 and FIG. 4.

First, an aggregate substrate 2A in which primary division grooves and secondary division grooves extending in a latticed pattern are formed is prepared. Front and back surfaces of the aggregate substrate 2A are sectioned into a number of chip formation regions by the primary division grooves and the secondary division grooves. Each of the chip formation regions serves as the insulating substrate 2 corresponding to one chip resistor. Although one chip formation region is representatively shown in FIG. 2, a number of such chip formation regions are actually arrayed in the latticed pattern.

An Ag paste is screen-printed on the back surface of the aggregate substrate 2A, and then dried. Thus, as shown in FIG. 2(*a*), a pair of back electrodes 8 which face each other with a predetermined interval therebetween are formed on longitudinally opposite end portions of each chip formation region (FIG. 3: step S-1).

As a next step, an Ag—Pd paste is screen-printed on the front surface of the aggregate substrate 2A, and then dried. Thus, as shown in FIG. 2(*b*), a pair of front electrodes 3 which face each other with a predetermined interval therebetween are formed on longitudinally opposite end portions of each chip formation region (step S-2). As described above, a silver-rich Ag—Pd-paste containing a large amount of Ag, such as an Ag—Pd paste containing 98 wt % Ag and 2 wt % Pd is used as the material for forming the front electrodes 3.

As a next step, the front electrodes 3 and the back electrodes 8 are sintered simultaneously at a high temperature of about 850° C. (step S-3). Incidentally, the front electrodes 3 and the back electrodes 8 may be sintered separately, or a formation sequence of the front electrodes 3 and the back electrodes 8 may be reversed so as to form the front electrodes 3 prior to the back electrodes 8.

As a next step, a resistive paste containing ruthenium oxide etc. is screen-printed on the front surface of the aggregate substrate 2A, and then dried. Thus, as shown in FIG. 2(*c*), a resistive element 4 whose opposite end portions are superimposed on the front electrodes 3 is formed (step S-4), and then sintered at a high temperature of about 850° C. (step S-5).

As a next step, an Ag-based paste containing 15 to 30 wt % Pd and Au, such as an Ag(75%)-Pd(20%)-Au(5%) paste is screen-printed on upper surfaces of the front electrodes 3, and then dried. Thus, as shown in FIG. 2(*d*), a pair of auxiliary electrodes 5 covering the front electrodes 3 and overlapping the end portions of the resistive element 4 are formed (step S-6), and then sintered at a high temperature of about 850° C. (step S-7).

As a next step, probes not shown are brought into contact with the pair of auxiliary electrodes 5 respectively so that a resistance value of the resistive element 4 can be measured through the probes (step S-8). It is determined whether the measured resistance value is lower than a target reference resistance value or not (step S-9). When an initial resistance value of the resistive element 4 is higher than the reference resistance value, that is, in the case of NO in the step S-9, the flow of processing returns to the step S-7 in which sintering at the high temperature of about 850° C. is performed again to reduce the resistance value of the resistive element 4. Then, the resistance value of the resistive element 4 is measured and compared with the reference resistance value (from the steps S-8 to S-9).

When the measured resistance value of the resistive element 4 is lower than the reference resistance value, i.e. in the case of YES in the step S-9, a glass paste is screen-printed on a region covering the resistive element 4 and then dried as a next step. Thus, as shown in FIG. 2(*e*), a first protective layer 6 covering the resistive element 4 is formed (FIG. 4: step S-10), and then sintered at a temperature of about 600° C. (step S-11).

As a next step, laser light is applied to forma not-shown trimming groove in the first protective layer 6 and the resistive element 4 while the probes are brought into contact with the pair of auxiliary electrodes 5 to measure the resistance value of the resistive element 4. Thus, the resistance value of the resistive element 4 is adjusted to be equal to the reference resistance value (step S-12).

As a next step, a resin paste such as an epoxy resin-based paste is screen-printed and thermally cured (baked) at a temperature of about 200° C. so as to cover the first protective layer 6. Thus, as shown in FIG. 2(*f*), a second protective layer 7 covering the entire first protective layer 6 and end portions of the auxiliary electrodes 5 is formed (step S-13). Incidentally, the aforementioned first protective layer 6 is provided for preventing the vicinity of the trimming groove in the resistive element 4 from being damaged by heat of the laser light. The second protective layer 7 is provided for protecting the resistive element 4 from an external environment.

The steps performed so far are batch processing on the aggregate substrate 2A. In a next step, the aggregate substrate 2A is primarily divided into strips along the primary division grooves (step S-14), so as to obtain strip-shaped substrates 2B each having a width in the longitudinal direction of the chip formation region.

In a next step, Ni/Cr or the like is sputtered on divided surfaces of each strip-shaped substrate 2B. Thus, as shown in FIG. 2(*g*), a pair of end surface electrodes 9 bridging the front electrodes 3 with the auxiliary electrodes 5 and the back electrodes 8 respectively are formed (step S-15). Then, the strip-shaped substrate is secondarily divided along the secondary division grooves (step S-16), so as to obtain single chips (individual pieces) each having an equal size to the chip resistor 1.

Finally, Ni plating or solder plating is applied to base electrode layers (the auxiliary electrodes 5, the back electrodes 8 and the end surface electrodes 9) of each single chip. Thus, as shown in FIG. 2(*h*), plating layers 10 having a layered structure to cover the base electrode layers are formed (step S-17). The chip resistor 1 shown in FIG. 1 is completed.

As described above, in the chip resistor 1 according to the first embodiment, the pair of front electrodes 3 connected to the opposite end portions of the resistive element 4 are covered with the auxiliary electrodes 5 so as to form a two-layer structure. Each front electrode 3 as a lower layer is formed of a material containing 1 to 5 wt % Pd and the balance Ag. Each auxiliary electrode 5 as an upper layer is formed of a material containing 15 to 30 wt % Pd and a metal material (e.g. Au) lower in resistivity than Pd and the balance Ag. Therefore, a change amount (drop amount) of the resistance value in the resistive element 4 which has been repeatedly sintered may increase so that the initial resistance value of the resistive element 4 can exceed the target reference resistance value. Even in such a case, the resistance value of the resistive element 4 can be lowered so that the resistive element 4 can be reproduced as a good product.

In addition, even when a large amount of Ag in the front electrodes 3 is diffused into the resistive element 4 by the repeated sintering, electrical continuity can be secured by Pd of the auxiliary electrodes 5 on edge portions of the front electrodes 3 from which Ag has been lost due to the diffusion. Therefore, a disconnection accident caused by separation can be prevented surely. In addition, even when a large amount of Pd high in resistivity is contained in the auxiliary electrodes 5, Au etc. lower in resistivity than Pd is also contained in the auxiliary electrodes 5. Therefore, even when the positions of the probes brought into contact with the auxiliary electrodes 5 have a variation during resistance value adjustment in which the resistive element 4 is trimmed to increase the resistance value, the variation hardly affects accuracy of measurement of the resistance value. Thus, the resistance value can be measured stably.

That is, according to the first embodiment, the resistive element is repeatedly sintered so that it is possible to lower the resistance value largely while preventing occurrence of the separation. Therefore, it is possible to provide a chip resistor suitable for lowering the initial resistance value.

[Second Embodiment]

Figure 5:
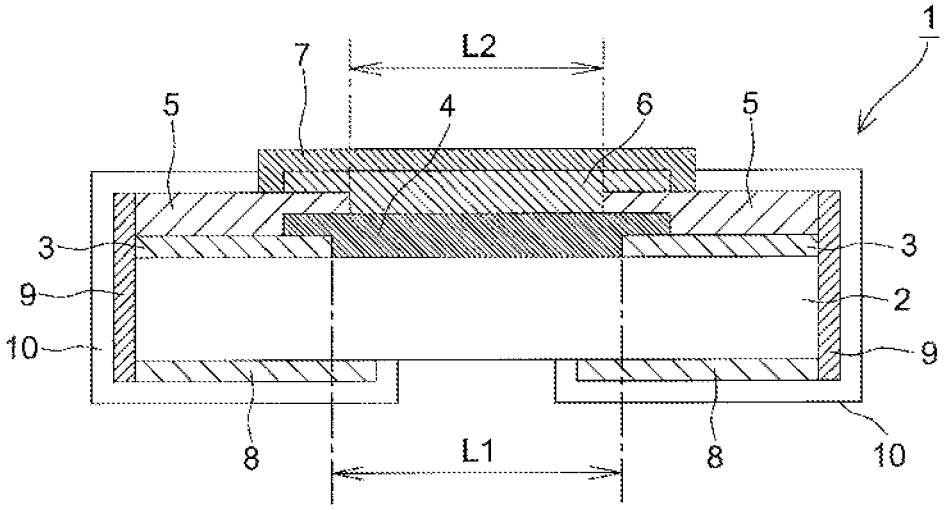
FIG. 5 A sectional view of a chip resistor according to a second embodiment of the invention.
Figure 6A:
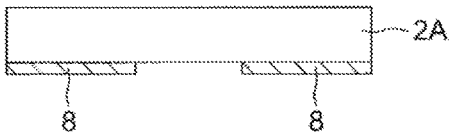
FIGS. 6A-6H Sectional views showing producing steps of the chip resistor shown in FIGS. 2A-2H.
Figure 6B:
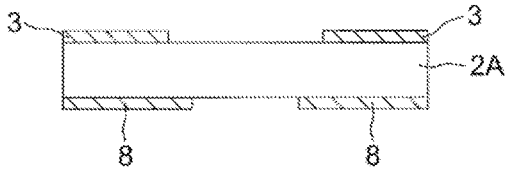
Figure 6C:
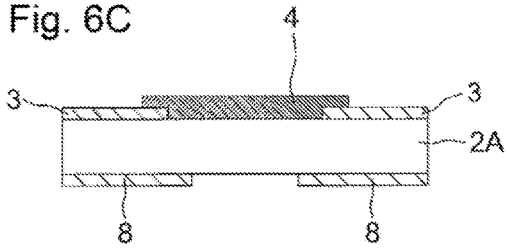
Figure 6D:
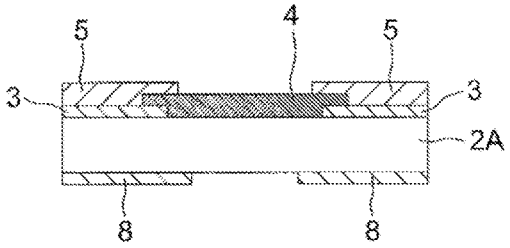
Figure 6E:
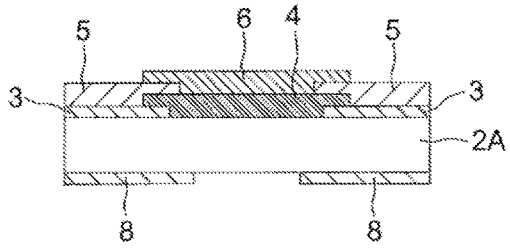
Figure 6F:
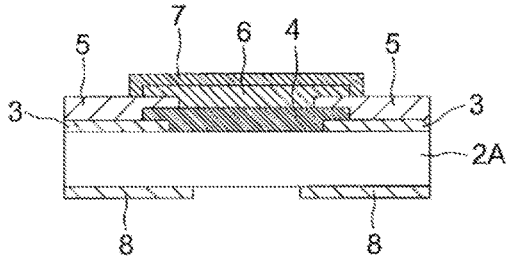
Figure 6G:
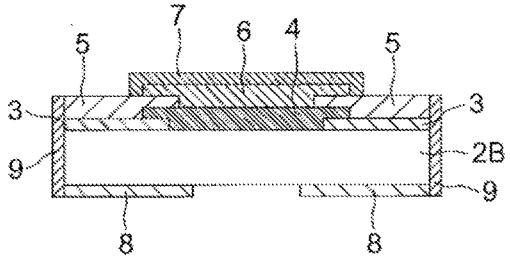
Figure 6H:
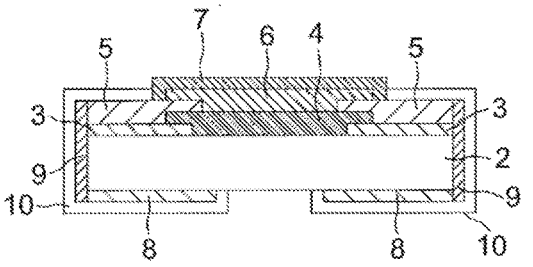

FIG. 5 is a sectional view of a chip resistor according to a second embodiment of the invention. Incidentally, in the following description, respective portions equal to those in the first embodiment will be referred to by the same signs respectively and correspondingly, and duplicated description thereof will be omitted properly.

As shown in FIG. 5, the chip resistor 1 according to the second embodiment of the invention is mainly constituted by a cuboid-shaped insulating substrate 2, a pair of front electrodes 3, a resistive element 4, a pair of auxiliary electrodes 5, a first protective layer 6, a second protective layer 7, a pair of back electrodes 8, a pair of end surface electrodes 9, and plating layers 10, in the same manner as in the first embodiment. The pair of front electrodes 3 are provided on longitudinally opposite end portions in an upper surface of the insulating substrate 2. The resistive element 4 is provided to extend onto the front electrodes 3. The pair of auxiliary electrodes 5 are provided so as to cover the front electrodes 3 and overlap end portions of the resistive element 4. The first protective layer 6 covers the resistive element 4. The second protective layer 7 covers the first protective layer 6. The pair of back electrodes 8 are provided on longitudinally opposite end portions in a lower surface of the insulating substrate 2. The end surface electrodes 9 are provided on side surfaces of the insulating substrate 2 so as to bridge the front electrodes 3 with the auxiliary electrodes 5 and the back electrodes 8 correspondingly and respectively. The plating layers 10 cover the auxiliary electrodes 5, the back electrodes 8 and the end surface electrodes 9 respectively.

The insulating substrate 2 is formed of ceramics etc. A number of such insulating substrates 2 are obtained in the same manner as in the first embodiment.

The front electrodes 3 are obtained by screen-printing, drying and sintering an Ag(silver)-based paste material containing 1 to 5 wt % Pd (palladium), such as an Ag—Pd paste containing 98 wt % Ag and 2 wt % Pd. The pair of front electrodes 3 face each other at a countervailing distance L1 on the insulating substrate 2.

The resistive element 4 has the same configuration as in the first embodiment. That is, the resistive element 4 is obtained by screen-printing, drying and sintering a resistive paste of ruthenium oxide etc.

The auxiliary electrodes 5 are obtained by screen-printing, drying and sintering an Ag-based paste material containing 15 to 30 wt % Pd and a metal material (e.g. gold or copper) lower in resistivity than Pd, and the balance Ag, in the same manner as in the first embodiment. An Ag—Pd—Au paste containing 20 wt % Pd, 5 wt % Au (gold) and the balance (75%) Ag is used for forming the auxiliary electrodes 5. The pair of auxiliary electrodes 5 face each other at a countervailing distance L2 on the resistive element 4. The countervailing distance L2 can be set desirably by selecting a screen printing mask pattern. However, in the case of the embodiment, the countervailing distance L2 between the pair of auxiliary electrodes 5 is set to be narrower than the countervailing distance L1 between the pair of front electrodes 3 (L1>L2).

The first protective layer 6 and the second protective layer 7 constitute an insulating layer having a two-layer structure. Configurations of the respective portions are the same as in the first embodiment.

The back electrodes 8 are also obtained by screen-printing, drying and sintering an Ag paste or an Ag—Pd paste containing a small amount of Pd, in the same manner as in the first embodiment.

The end surface electrodes 9 are also formed by sputtering nickel (Ni)/chromium (Cr) etc. in the same manner as in the first embodiment. The end surface electrodes 9, the auxiliary electrodes 5 and the back electrodes 8 are covered with the plating layers 10 formed by Ni plating, solder plating, or the like.

Figure 8:
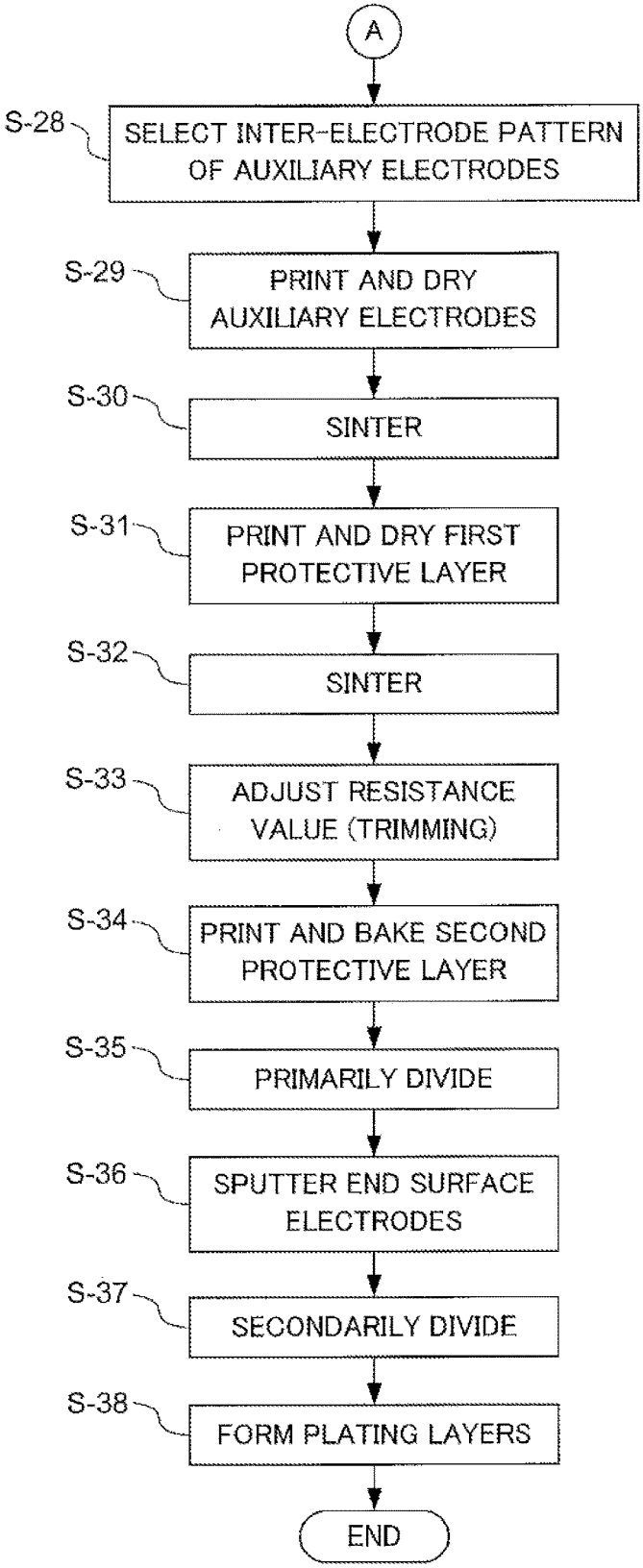
FIG. 8 A flow chart (part 2) showing the producing steps of the chip resistor shown in FIGS. 2A-2H.
Figure 9:
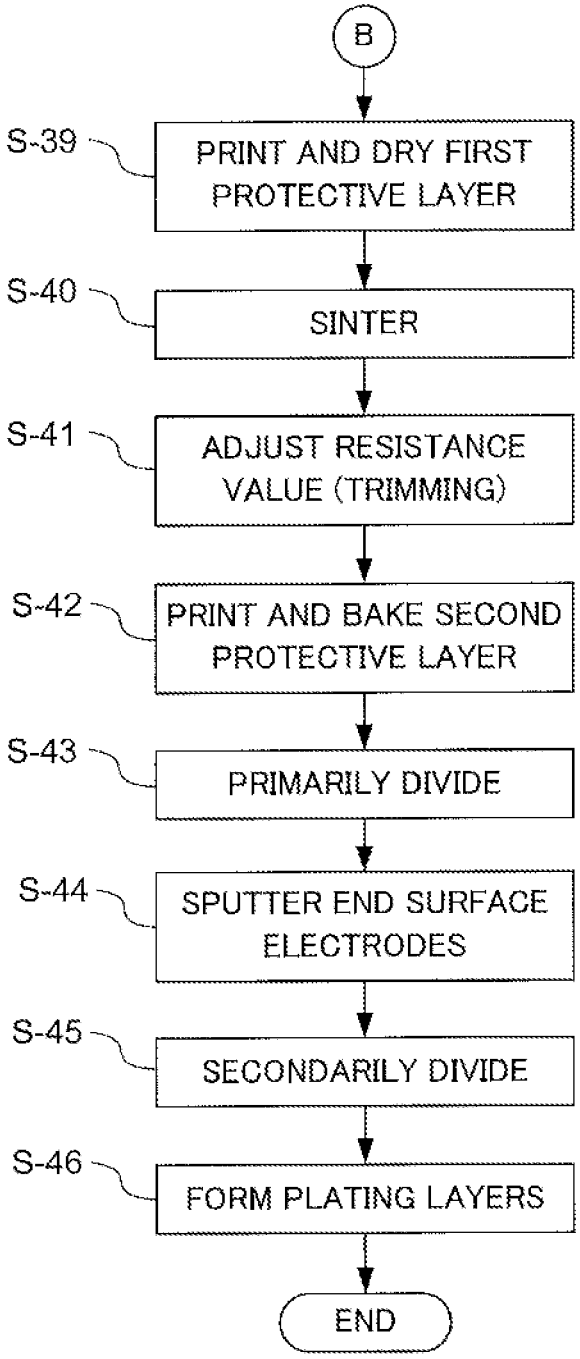
FIG. 9 A flow chart (part 3) showing the producing steps of the chip resistor shown in FIGS. 2A-2H.
Figure 10:
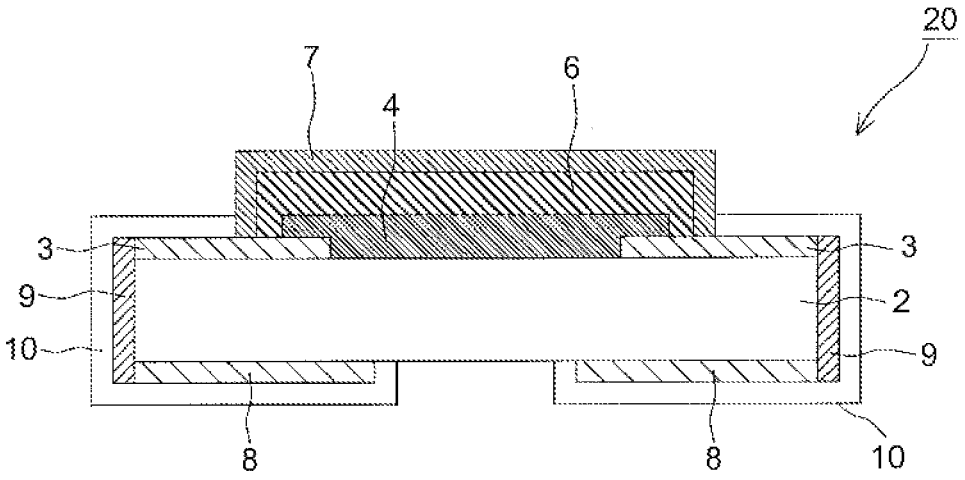
FIG. 10 A sectional view of the chip resistor produced by the steps shown in FIG. 9.

Next, a method for producing the chip resistor 1 configured as described above will be described with reference to FIGS. 6 to 10. Incidentally, FIG. 6 are sectional views showing producing steps of the chip resistor shown in FIG. 5. FIGS. 7 to 9 are flow charts showing the producing steps of the chip resistor shown in FIG. 5. FIG. 10 is a sectional view of the chip resistor produced by the steps shown in FIG. 9. Incidentally, one processing procedure is shown in FIG. 7, FIG. 8 and FIG. 9.

First, an aggregate substrate 2A in which primary division grooves and secondary division grooves extending in a latticed pattern are formed is prepared. Front and back surfaces of the aggregate substrate 2A are sectioned into a number of chip formation regions by the primary division grooves and the secondary division grooves. Each of the chip formation regions serves as an insulating substrate 2 corresponding to one chip resistor. Although one chip formation region is representatively shown in FIG. 6, a number of such chip formation regions are actually arrayed in the latticed pattern.

An Ag paste is screen-printed on the back surface of the aggregate substrate 2A, and then dried. Thus, as shown in FIG. 6(*a*), a pair of back electrodes 8 facing each other with a predetermined interval therebetween are formed on longitudinally opposite end portions of each chip formation region (FIG. 7: step S-21).

As a next step, an Ag—Pd paste is screen-printed on the front surface of the aggregate substrate 2A, and then dried. Thus, as shown in FIG. 6(*b*), a pair of front electrodes 3 facing each other with a predetermined interval therebetween are formed on longitudinally opposite end portions of each chip formation region (step S-22). As described above, a silver-rich Ag—Pd-paste containing a large amount of Ag, such as an Ag—Pd paste containing 98 wt % Ag and 2 wt % Pd is used as the material for forming the front electrodes 3.

As a next step, the front electrodes 3 and the back electrodes 8 are sintered simultaneously at a high temperature of about 850° C. (step S-23). Incidentally, the front electrodes 3 and the back electrodes 8 may be sintered separately, or a formation sequence of the front electrodes 3 and the back electrodes 8 may be reversed to form the front electrodes 3 prior to the back electrodes 8.

As a next step, a resistive paste containing ruthenium oxide etc. is screen-printed on the front surface of the aggregate substrate 2A, and then dried. Thus, as shown in FIG. 6(*c*), a resistive element 4 whose opposite end portions are superimposed on the front electrodes 3 is formed (step S-24), and then sintered at a high temperature of about 850° C. (step S-25).

As a next step, probes not shown are brought into contact with the pair of front electrodes 3 respectively so that an initial resistance value of the resistive element 4 can be measured through the probes (step S-26). It is determined whether the measured initial resistance value exceeds a target reference resistance value or not (step S-27). When the measured initial resistance value is higher than the reference resistance value (YES in the step S-27), the flow of processing goes to a step S-28 in FIG. 8.

In the step S-28, a desired inter-electrode pattern is selected from a plurality of prepared printing masks based on a resistance value distribution of the respective resistive elements 4 on the aggregate substrate 2A measured in the step S-26, and a countervailing distance L2 between auxiliary electrodes 5 which will be formed in a next step is determined. That is, an inter-electrode distance of a current flowing in each resistive element 4 is determined by a narrower one of the countervailing distance L1 between the front electrodes 3 and the countervailing distance L2 between the auxiliary electrodes 5. Accordingly, in a case of a resistance value distribution in which most of the measured resistance values largely exceed the reference resistance value, a somewhat short inter-electrode pattern satisfying the relation L1>L2 is selected. In a case of a resistance value distribution where most of the measured resistance values do not exceed the reference resistance value so much, or in a case of a resistance value distribution where some measured resistance values exceed the reference resistance value while the other measured resistance values do not exceed the reference resistance value, a somewhat long inter-electrode pattern satisfying the relation L1≤L2 is selected.

As a next step, an Ag-based paste containing 15 to 30 wt % of Pd and Au, such as an Ag(75%)-Pd(20%)-Au(5%) paste is screen-printed on upper surfaces of the front electrodes 3 using a printing mask having the selected inter-electrode pattern, and then dried. Thus, as a shown in FIG. 6(*d*), a pair of auxiliary electrodes 5 covering the front electrodes 3 and overlapping the end portions of the resistive element 4 are formed (step S-29), and then sintered at a high temperature of about 850° C. (step S-30).

As a next step, a glass paste is screen-printed on a region covering the resistive element 4 and then dried. Thus, as shown in FIG. 6(*e*), a first protective layer 6 covering the resistive element 4 is formed (step S-31), and then sintered at a temperature of about 600° C. (step S-32).

As a next step, laser light is applied to forma not-shown trimming groove in the first protective layer 6 and the resistive element 4 while the probes are brought into contact with the pair of auxiliary electrodes 5 to measure the resistance value of the resistive element 4. Thus, resistance value adjustment is performed to make the resistance value of the resistive element 4 equal to the reference resistance value (step S-33).

As a next step, a resin paste such as an epoxy resin-based paste is screen-printed and thermally cured (baked) at a temperature of about 200° C. so as to cover the first protective layer 6. Thus, as shown in FIG. 6(*f*), a second protective layer 7 covering the entire first protective layer 6 and end portions of the auxiliary electrodes 5 is formed (step S-34). Incidentally, the aforementioned first protective layer 6 is provided for preventing the vicinity of the trimming groove in the resistive element 4 from being damaged by heat of the laser light. The second protective layer 7 is provided for protecting the resistive element 4 from an external environment.

The steps performed so far are batch processing on the aggregate substrate 2A. In a next step, the aggregate substrate 2A is primarily divided into strips along the primary division grooves (step S-35), so as to obtain strip-shaped substrates 2B each having a width in the longitudinal direction of the chip formation region.

In a next step, Ni/Cr or the like is sputtered on divided surfaces of each strip-shaped substrate 2B. Thus, as shown in FIG. 6(*g*), a pair of end surface electrodes 9 bridging the front electrodes 3 with the auxiliary electrodes 5 and the back electrodes 8 respectively are formed (step S-36). Then, the strip-shaped substrate is secondarily divided along the secondary division grooves (step S-37), so as to obtain single chips (individual pieces) each having an equal size to the chip resistor 1.

Finally, Ni plating or solder plating is applied to base electrode layers (the auxiliary electrodes 5, the back electrodes 8 and the end surface electrodes 9) of each single chip. Thus, as shown in FIG. 6(*h*), plating layers 10 having a layered structure to cover the base electrode layers are formed (step S-38). The chip resistor 1 shown in FIG. 5 is completed.

The steps from the aforementioned step S-28 to the aforementioned step S-38 are steps executed when the initial resistance value exceeds the target reference resistance value. However, when all or most of the resistance values measured in the step S-26 are largely lower than the reference resistance value, i.e. when each initial resistance value is lower than the reference resistance value in the step S-27 (NO), the flow of processing goes to a step S-39 in FIG. 9, in which a chip resistor 20 shown in FIG. 10 is produced.

In the step S-39, a glass paste is screen-printed on a region covering the resistive element 4 and then dried. Thus, a first protective layer 6 covering the resistive element 4 is formed, and then sintered at a temperature of about 600° C. (step S-40).

As a next step, laser light is applied to form a trimming groove in the first protective layer 6 and the resistive element 4 while the probes are brought into contact with the pair of front electrodes 3 to measure the resistance value of the resistive element 4. Thus, resistance value adjustment is performed to make the resistance value of the resistive element 4 equal to the reference resistance value (step S-41).

As a next step, a resin paste such as an epoxy resin-based paste is screen-printed and thermally cured (baked) at a temperature of about 200° C. so as to cover the first protective layer 6. Thus, a second protective layer 7 covering the entire first protective layer 6 is formed (step S-42).

The steps performed so far are batch processing on the aggregate substrate 2A. In a next step, the aggregate substrate 2A is primarily divided into strips along the primary division grooves, so as to obtain strip-shaped substrates each having a width in the longitudinal direction of the chip formation region (step S-43).

In a next step, Ni/Cr or the like is sputtered on divided surfaces of each strip-shaped substrate. Thus, a pair of end surface electrodes 9 bridging the front electrodes 3 and the back electrodes 8 respectively are formed (step S-44). Then, the strip-shaped substrate is secondarily divided along the secondary division grooves (step S-45), so as to obtain single chips (individual pieces) each having an equal size to the chip resistor 1.

Finally, Ni plating or solder plating is applied to base electrode layers (the back electrodes 8 and the end surface electrodes 9) of each single chip. Thus, plating layers 10 having a layered structure to cover the base electrode layers are formed (step S-46). The chip resistor 20 shown in FIG. 10 is completed.

Assume that the initial resistance value of the resistive element 4 is higher than the target reference resistance value when the resistance value is measured by the probes brought into contact with the pair of front electrodes 3. In this case, in the method for producing the chip resistor 1 according to the embodiment, as described above, the resistance value of the resistive element 4 can be lowered by sintering performed repeatedly in the subsequent steps for forming and superimposing the auxiliary electrodes 5 on the front electrodes 3 or for forming the first and second protective layers 6 and 7. That is, even when the measured resistance value is higher than the reference resistance value, the resistive element can be sintered again to lower the resistance value while preventing an adverse effect caused by diffusion of silver. Therefore, a chip resistor which would have been discarded as a defective product can be reproduced as a good product.

In this case, even when a large amount of Ag in the front electrodes 3 is diffused into the resistive element 4 by the repeated sintering, electrical continuity can be secured by Pd of the auxiliary electrodes 5 on the edge portions of the front electrodes 3 from which Ag has been lost due to the diffusion. Therefore, a disconnection accident caused by separation can be prevented surely. In addition, Au etc. lower in resistivity than Pd is also contained in the auxiliary electrodes 5. Therefore, even when the positions of the probes brought into contact with the back electrodes 5 have a variation during resistance value adjustment (see the step S-33) in which the resistive element 4 is trimmed to increase the resistance value, the variation hardly affects accuracy of measurement of the resistance value. Thus, the resistance value can be measured stably.

In addition, in the method for producing the chip resistor 1 according to the embodiment, the countervailing distance L2 between the auxiliary electrodes 5 can be changed in accordance with a divergence amount of the initial resistance value from the reference resistance value. A desired inter-electrode pattern is selected from the plurality of prepared printing masks based on the resistance value distribution of the respective resistive elements 4 on the aggregate substrate 2A measured in the step S26. Accordingly, the countervailing distance L2 between the auxiliary electrodes 5 which will be formed in a next step is determined. Therefore, even when the initial resistance value largely exceeds the reference resistance value, an inter-electrode pattern in which the countervailing distance L2 between the auxiliary electrodes 5 is narrower than the countervailing distance L1 between the front electrodes 3 can be selected. Thus, the resistance value of the resistive element 4 can be lowered by the auxiliary electrodes 5 formed thus. In addition, a current flowing in the resistive element 4 flows through the auxiliary electrodes 5 containing a large amount of Pd. Thus, the current jumps over portions of the resistive element 4 in the vicinities of the front electrodes 3 from which a large amount of Ag has been diffused. Accordingly, temperature characteristics are also improved.

Incidentally, although the step (the step S28) for selecting the countervailing distance L2 between the auxiliary electrodes 5 at a most suitable dimension based on the measured resistance value distribution is provided in the aforementioned embodiment, the countervailing distance L2 between the auxiliary electrodes 5 may be always fixed and unchangeable. In this case, even when the countervailing distance L2 between the auxiliary electrodes 5 is set to be wider than the countervailing distance L1 between the front electrodes 3 (L2>L1), the resistance value of the resistive element 4 can be lowered by repeated sintering. However, the countervailing distance L2 between the auxiliary electrodes 5 is preferably set to be narrower than the countervailing distance L1 between the front electrodes 3 (L1>L2), as shown in FIG. 5.

REFERENCE SIGNS LIST

1, 20 chip resistor
2 insulating substrate
2A aggregate substrate
2B strip-shaped substrate
3 front electrode
4 resistive element
5 auxiliary electrode
6 first protective layer
7 second protective layer
8 back electrode
9 end surface electrode
10 plating layer

The invention claimed is:

1. A chip resistor comprising: an insulating substrate; a pair of front electrodes which are provided on a front surface of the insulating substrate so as to face each other with a predetermined interval therebetween; a resistive element which is provided to extend onto the pair of front electrodes; and auxiliary electrodes which are provided so as to cover the front electrodes and overlap end portions of the resistive element; wherein:

the front electrodes are formed of a material which contains 1 to 5 wt % palladium and the balance silver, and the auxiliary electrodes are formed of a material containing 15 to 30 wt % palladium and a metal material lower in resistivity than palladium and the balance silver.

2. A chip resistor according to claim 1, wherein:

a countervailing distance between the auxiliary electrodes is set to be narrower than a countervailing distance between the front electrodes.

3. A chip resistor according to claim 1, wherein:

the resistive element has a resistance value which has been lowered by re-sintering.

4. A method for producing a chip resistor comprising:

a step of printing and sintering a paste material on a front surface of an insulating substrate to form a pair of front electrodes, the paste material containing silver as a main component;

a step of printing and sintering a resistive paste to form a resistive element so that the resistive element can extend onto the pair of front electrodes;

a step of bringing probes into contact with the pair of front electrodes to measure an initial resistance value of the resistive element;

a step of forming a pair of auxiliary electrodes so as to cover the front electrodes and overlap end portions of the resistive element only when the initial resistance value is higher than a reference resistance value; and a step of re-sintering the resistive element after formation of the auxiliary electrodes so as to lower the initial resistance value; wherein:

the front electrodes are formed of a material containing 1 to 5 wt % palladium and the balance silver; and the auxiliary electrodes are formed by printing and sintering a paste material containing 15 to 30 wt % palladium and a metal material lower in resistivity than palladium and the balance silver.

5. A method for producing a chip resistor according to claim 4, wherein:

a countervailing distance between the auxiliary electrodes can be changed in accordance with a divergence amount of the initial resistance value from the reference resistance value.

6. A method for producing a resistor chip according to claim 4, wherein:

the auxiliary electrodes are superimposed on end portions of the resistive element so that a countervailing distance between the auxiliary electrodes can be narrower than a countervailing distance between the front electrodes.

* * * * *